US009975307B2

(12) United States Patent
Rotholz

(10) Patent No.: US 9,975,307 B2
(45) **Date of Patent: *May 22, 2018**

(54) CORRUGATED FURNITURE DESIGN AND CONSTRUCTION SYSTEM

(71) Applicant: Zachary Rotholz, New Haven, CT (US)

(72) Inventor: Zachary Rotholz, New Haven, CT (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/616,309

(22) Filed: Jun. 7, 2017

(65) Prior Publication Data

US 2017/0334161 A1 Nov. 23, 2017

Related U.S. Application Data

(63) Continuation of application No. 14/664,256, filed on Mar. 20, 2015, now Pat. No. 9,701,090.

(60) Provisional application No. 61/974,039, filed on Apr. 2, 2014.

(51) Int. Cl.

| | |
|---|---|
| ***A47B 5/00*** | (2006.01) |
| ***B31D 5/00*** | (2017.01) |
| ***A47B 19/00*** | (2006.01) |
| ***B31D 5/04*** | (2017.01) |
| *A47F 5/11* | (2006.01) |

(52) U.S. Cl.

CPC ..... *B31D 5/00* (2013.01); *A47B 19/00* (2013.01); *B31D 5/04* (2013.01); *A47B 2220/0086* (2013.01); *A47B 2230/0092* (2013.01); *A47F 5/11* (2013.01)

(58) Field of Classification Search

CPC ..... A47B 3/12; A47B 3/06; A47B 2220/083; A47B 2220/0086; A47B 43/02; A47C 5/005; Y10T 428/13; Y10T 428/1303

USPC ..... 248/174; 312/195; 108/51.3, 153.1, 156, 108/157.1, 157.14, 157.15, 157.16, 108/157.18, 159, 158.12, 161; 493/104, 493/79, 68

See application file for complete search history.

(56) References Cited

U.S. PATENT DOCUMENTS

| | | | |
|---|---|---|---|
| 3,121,588 | A | 2/1964 | Beckman et al. |
| 3,212,464 | A | 10/1965 | Steuer |
| 3,566,808 | A | 3/1971 | Slate et al. |
| 3,620,175 | A | 11/1971 | Crane et al. |
| 3,714,908 | A | 2/1973 | Notko |
| 3,724,399 | A | 4/1973 | Notko et al. |
| 3,729,244 | A | 4/1973 | Butler |
| 3,807,823 | A | 4/1974 | Rouse |
| 3,837,719 | A | 9/1974 | Barron |

(Continued)

FOREIGN PATENT DOCUMENTS

| | | |
|---|---|---|
| DE | 9104898 | 8/1991 |
| DE | 4344651 | 6/1995 |

OTHER PUBLICATIONS

Zach Rotholz, "Furniture designs," www.chairigami.com, pp. 1-2, retrieved from internet on Mar. 17, 2015.

(Continued)

*Primary Examiner* — Janet M Wilkens

(74) *Attorney, Agent, or Firm* — Fish & Richardson P.C.

(57) ABSTRACT

A piece of furniture such as a standing desk is constructed of intersecting folded prisms provided with a novel slot joint system which affords lateral and torsional stability, simplicity, and long life to such furniture.

17 Claims, 5 Drawing Sheets

(56) References Cited

U.S. PATENT DOCUMENTS

| | | | | |
|---|---|---|---|---|
| 3,866,550 | A | 2/1975 | Geschwender | |
| 3,871,726 | A | 3/1975 | Stegner | |
| 4,102,525 | A | 7/1978 | Albano | |
| 4,186,846 | A | 2/1980 | Jacalone et al. | |
| 4,373,449 | A * | 2/1983 | Klaus | A47B 47/06 108/60 |
| D270,411 | S | 9/1983 | DeGregori | |
| 4,632,040 | A | 12/1986 | Sheffer | |
| 4,753,341 | A * | 6/1988 | McIntyre | B65D 5/48018 211/130.1 |
| 5,370,064 | A | 12/1994 | Sgabellone | |
| 5,394,810 | A | 3/1995 | Howard et al. | |
| 5,486,078 | A | 1/1996 | Wise et al. | |
| 5,836,254 | A | 11/1998 | Johansson | |
| 6,325,343 | B1 | 12/2001 | Flagg | |
| 8,001,910 | B2 | 8/2011 | Yee et al. | |
| 2004/0237850 | A1 | 12/2004 | Horiuchi | |
| 2005/0204968 | A1 | 9/2005 | Butkus et al. | |
| 2009/0251034 | A1 | 10/2009 | Nielsen et al. | |
| 2013/0080286 | A1 | 3/2013 | Rotholz | |

OTHER PUBLICATIONS

Trent Mayol, SmartDeco LLC, www.smartdecofurniture.com, pp. 1-4, retrieved from internet on Mar. 17, 2015.

Karton Group, www.kartongroup.com.au, pp. 1-7, retrieved from internet on Mar. 17, 2015.

Wilson Brothers, www.wilsonbrothers.co.uk, pp. 1-3, retrieved from internet on Mar. 17, 2015.

* cited by examiner

CORRUGATED FURNITURE DESIGN AND CONSTRUCTION SYSTEM

RELATED APPLICATIONS

This application is a continuation and claims priority under 35 U.S.C. § 120 to U.S. patent application Ser. No. 14/664,256, which was filed Mar. 20, 2015, which claims priority under 35 USC § 119(e) to provisional U.S. patent application Ser. No. 61/974,039, which was filed Apr. 2, 2014, the entire contents of each of which are hereby incorporated by reference.

BACKGROUND

This description relates to corrugated furniture design and construction.

Prolonged sitting is known to have negative health effects. Standing desks are an excellent alternative to sedentary desks as they allow users to work on their feet. Standing while working engages muscles in the back and legs, increases metabolism, and burns more calories. Standing desks are a healthy means of increasing both physical activity and mental focus in the work place. Known standing desks typically are expensive, heavy-weight furniture pieces, utilize materials that are difficult if not impossible to recycle, and are not produced from sustainable materials and processes.

Corrugated fiberboard (which we sometimes refer to simply as cardboard) has long been used in the shipping and transit industries. The material is recyclable, sustainable, and lightweight, and provides an inexpensive means to package items. Single wall cardboard typically has a fluted layer sandwiched between two kraft liner boards. Designers have used corrugated fiberboard for both home and office furniture. This furniture is lightweight, can be flat-packed when not assembled, is recyclable, and is readily customizable with pens or paints.

Known single-wall cardboard desks have complicated assembly procedures leading to user frustration and also contain multiple parts resulting in expensive manufacturing costs. Known cardboard desk designs do not have the lateral or torsional stability to adequately support a higher standing work surface. Known cardboard desk designs utilize fasteners and glues to achieve stiffness and rigidity.

SUMMARY

By folding corrugated cardboard sheets (in some cases single wall corrugated cardboard sheets) into simple rectangular and triangular prisms that easily slot together, an elegant cardboard standing desk can be achieved which is easy to assemble and affordable. This standing desk employs a new joint design which tightens as prisms are slotted into one another and becomes stiffer when the structure is heavily weighted.

A piece of furniture such as a standing desk is constructed of intersecting folded prisms provided with a novel slot joint system. This novel slot joint affords greater lateral and torsional stability, simplicity, and long life to such furniture. Folding and mating such prisms using the slot joint system enables the construction of simple, durable, and lightweight structures which can be implemented as furniture having work surfaces of varying heights.

A primary objective is to provide lightweight, flat-packing and inexpensive furniture solutions.

Another objective is to provide a unique locking slot joint design with a folded conjoined structural prism design creating a construction system which allows for lightweight, simple, and rigid furniture pieces produced from flat material sheets such as corrugated cardboard.

A further objective is to implement the construction system using sheets of corrugated cardboard (in many cases, single-wall corrugated cardboard) to produce standing desks or other table structures of varying heights that are affordable, flat-packing, lightweight, strong, easy to assemble, and eco-friendly.

In some instances, the furniture unit comprises at least three flat corrugated sheets corresponding to a horizontal work surface A and two vertical support structures B, C. A fourth corrugated sheet D may be implemented as a support brace. (FIG. 1)

Thus, in general, in an aspect, a cardboard furniture structure includes at least two separate folded cardboard structural pieces, each of the two pieces including at least two conjoined prisms. A first one of the two pieces forms a vertical support. A second one of the two pieces includes a non-vertical functional surface. The two separate folded cardboard structural pieces are interconnected at one or more slot joints. The slot joints are configured to hold the two separate folded cardboard structural pieces together and to enhance the strength of the cardboard furniture structure.

Implementations may include one or any combination of two or more of the following features. The cardboard furniture structure includes a third separate folded cardboard structural piece that includes at least two conjoined prisms and forms a second vertical support. The third piece and the first one of the two pieces interconnect with the second piece at one or more slot joints. The slot joints are configured to join the second piece with the first piece and the third piece to enhance the strength (and stiffness) of the cardboard furniture structure. There is also a fourth separate folded cardboard structural piece. The fourth piece is configured to connect to the first and third pieces at two or more slot joints. The slot joints are configured to enhance the strength (and stiffness) of the cardboard furniture structure. The non-vertical functional surface includes a desk surface. The cardboard furniture structure forms a desk. The cardboard furniture structure forms a standup desk. The cardboard furniture structure forms a desk that is configured to be placed on an existing desk to form a standup desk. The two conjoined prisms of the second piece include triangular prisms. The two conjoined prisms of the first piece include rectangular prisms. At least one of the pieces includes a folded sheet of single-wall cardboard. Each of the slot joints includes two slots, one on each of the pieces. Each of the two separate folded cardboard structural pieces includes panels formed by folding cardboard sheets, and the slot on each of the pieces includes at least two adjacent slot elements that are formed on respectively different panels of the folded cardboard sheets. At least one of the slots of one of the slot joints is tapered to enhance the strength of the cardboard furniture structure when the slot joint is formed.

In general, in an aspect, a cardboard furniture structure is formed by folding at least two sheets of single-wall cardboard to form two folded cardboard structural pieces each including at least two conjoined prisms and at least two slot elements that cooperate to form a slot of the structural piece. One of the slots on one of the structural pieces is mated with a corresponding one of the slots on the other piece to form a slot joint that connects the two pieces and enhances the strength of the cardboard furniture structure.

Implementations may include one or any combination of two or more of the following features. A third sheet of single-wall cardboard is folded to form a third cardboard structural piece that includes at least two conjoined prisms and at least two slot elements that cooperate to form a slot of the third structural piece. One of the slots of the third structural piece is mated with one of the two structural pieces to form a slot joint that connects the pieces and enhances the strength of the cardboard furniture structure.

In general, in an aspect, a cardboard standup desk includes two folded single-wall cardboard vertical support pieces, each of the two vertical support pieces including two conjoined rectangular prisms and a slot formed of three slot elements on respective panels of the folded single-wall cardboard vertical support piece. A third folded single-wall cardboard work surface piece includes two conjoined triangular prisms and two slots each formed of two slot elements on respective panels of the folded single-wall cardboard work surface piece. The two slots of the work surface piece are mated with the two respective slots of the two vertical support pieces. A fourth folded single-wall cardboard non-vertical support piece connects the two vertical support pieces at a location below the work surface piece.

These and other features, aspects, and implementations can be expressed as systems, components, apparatus, methods, means or steps for performing functions, and in other ways.

These and other features, aspects, and implementations will become apparent from the following description, and from the claims.

DESCRIPTION

DESK COMPONENTS

Figure 1:
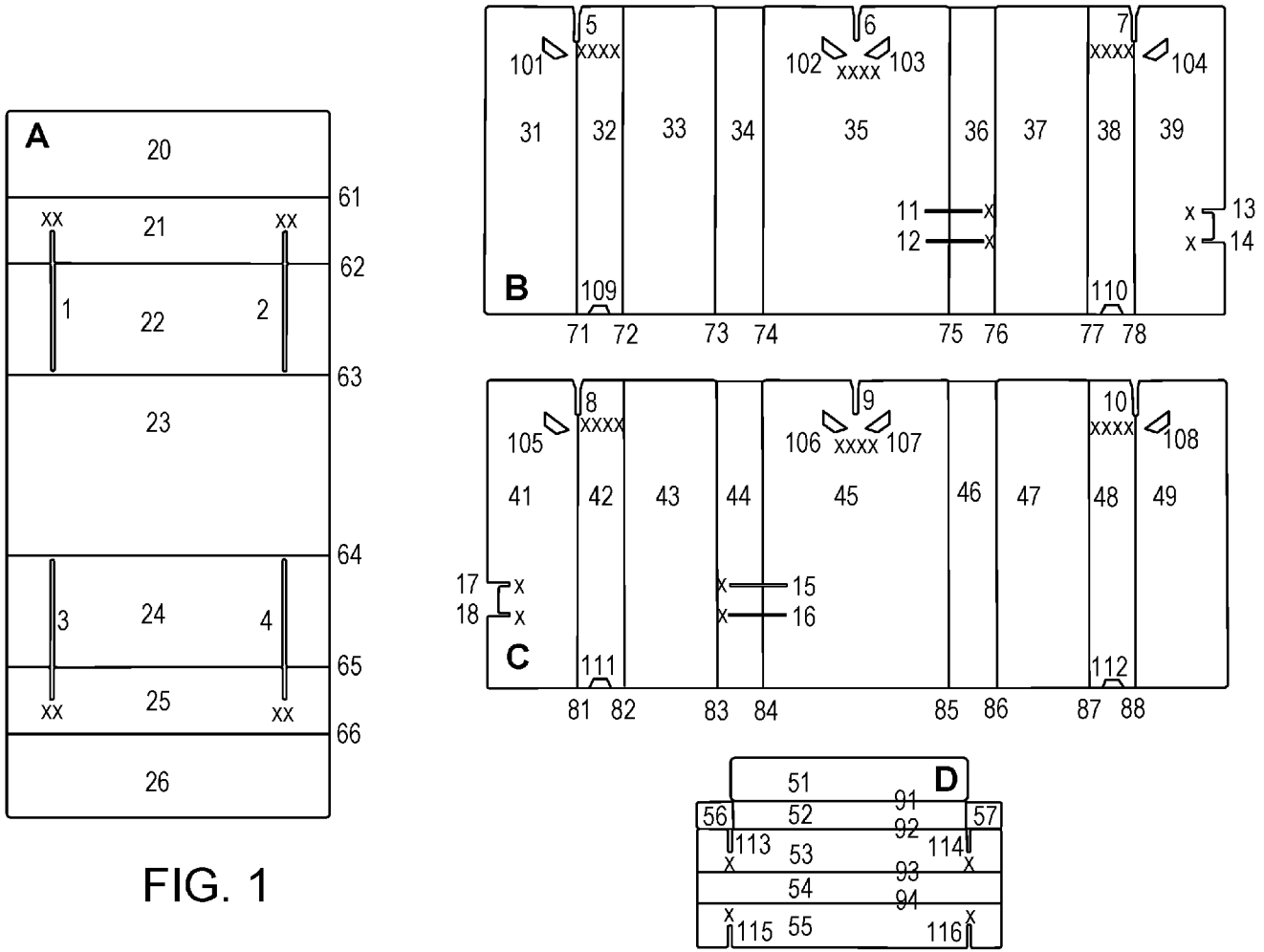
FIG. 1 is an unfolded view of the parts of a disassembled standing desk.

A first rectangular sheet A includes six parallel scores 61, 62, 63, 64, 65, 66 and four parallel slots 1, 2, 3, 4. The six parallel scores 61, 62, 63, 64, 65, 66 separate the sheet into seven horizontal panels 20, 21, 22, 23, 24, 25, 26. Of the four parallel slots, two slots with thickness (or width) xx are cut on opposite sides of panels 21 and 22 perpendicular to the score 62. Slots 1, 2 begin in the middle of panel 21 and terminate in panel 22, just short of the score 63. The remaining two slots with thickness (width) xx are cut on opposite sides of panels 24 and 25 perpendicular to the score 65. Slots 3 and 4 begin near the 64 score and in panel 24 and terminate in the middle of panel 25. (FIG. 1)

A second rectangular sheet B includes eight parallel scores 71, 72, 73, 74, 75, 76, 77, 78 three vertical support slots 5, 6, 7 of width xxxx and four horizontal brace slots 11, 12, 13, 14 of width x The eight parallel scores 71, 72, 73, 74, 75, 76, 77, 78 separate the sheet into nine vertical panels 31, 32, 33, 34, 35, 36, 37, 38, 39. Each of the three vertical support slots 5, 6, 7 is tapered from a broad end at the edge of the panel to a narrow end that has width xxxx. The three vertical support slots 5, 6, 7 are parallel to all scores and lie along the top edge of sheet B. Slot 5 lies along score 71, slot 6 is positioned in the middle of panel 35, and slot 7 lies along score 78. Four horizontal brace slots 11, 12, 13, 14 are perpendicular to scores in sheet B and are positioned near the bottom of sheet B. Slots 11, 12 are positioned along score 75 beginning in panel 35 and terminating near score 76 in panel 36. Slots 13, 14 lie along the right edge of sheet B in panel 39 and are aligned with slots 11, 12 respectively. Slots 13, 14 merge into a broader opening along the edge of the sheet as shown. Sheet B may also contain four locking tabs 101, 102, 103, 104 and two other locking tabs 109, 110 to aid the assembly of the disclosed piece of furniture. (FIG. 1). Each of the locking tabs is die cut into the sheet and can be folded out as a tab.

A third rectangular sheet C, like sheet B, includes eight parallel scores 81, 82, 83, 84, 85, 86, 87, 88 three vertical support slots 8, 9, 10 of width xxxx and four horizontal brace slots 15, 16, 17, 18 of width x. The eight parallel scores 81, 82, 83, 84, 85, 86, 87, 88 separate the sheet into nine vertical panels 41, 42, 43, 44, 45, 46, 47, 48, 49. Each of the three vertical support slots 8, 9, 10 is tapered from a broad end at the edge of the panel to a narrow end that has width xxxx. The three vertical support slots 8, 9, 10 are parallel to all scores and lie along the top edge of sheet C. Slot 8 lies along score 81, slot 9 is positioned in the middle of panel 45, and slot 10 lies along score 88. Four horizontal brace slots 15, 16, 17, 18 are perpendicular to scores in sheet C and are positioned near the bottom of sheet C. Slots 15, 16 are positioned along score 84 beginning in panel 45 and terminating near score 83 in panel 44. Slots 17, 18 lie along the left edge of sheet C in panel 41 and are aligned with slots 15, 16 respectively. Sheet C may also contain four locking tabs 105, 106, 107, 108 and two other locking tabs 111,112 to aid the assembly of the disclosed piece of furniture. (FIG. 1). Each of the locking tabs is die cut into the sheet and can be folded out as a tab.

A fourth sheet D may be used as a support brace for the piece of furniture and includes four parallel scores 91, 92, 93, 94 that separate five horizontal panels 51, 52, 53, 54, 55. Sheet D may also contain two side panels 56, 57 to maintain the prism structure when folded. Sheet D has two pairs of parallel slots 113, 114 and 115, 116 all of width x that lie along the top edge of panel 53 and along the bottom edge of panel 55 respectively. (FIG. 1)

In some implementations of a desk design intended for working while standing, the panels and slots of sheet A have the following dimensions outlined in these tables.

| Panel | Width (inches) | Height (inches) |
|---|---|---|
| 20 | 41.5 | 11.5 |
| 21 | 41.5 | 9 |
| 22 | 41.5 | 14.875 |
| 23 | 41.5 | 24.25 |
| 24 | 41.5 | 14.875 |

-continued

| Panel | Width (inches) | Height (inches) |
|---|---|---|
| 25 | 41.5 | 9 |
| 26 | 41.5 | 11.5 |

| Slot | Distance to Edge (inches) | Thickness [xx] (inches) | Short Slot Segment (inches) | Long Slot Segment (inches) |
|---|---|---|---|---|
| 1 | 5.625 | 0.375 | 4.5 | 14.1875 |
| 2 | 5.625 | 0.375 | 4.5 | 14.1875 |
| 3 | 5.625 | 0.375 | 4.5 | 14.1875 |
| 4 | 5.625 | 0.375 | 4.5 | 14.1875 |

In such implementations, the panels and slots of sheet B may have the following dimensions outlined in these tables.

| Panel | Width (inches) | Height (inches) |
|---|---|---|
| 31 | 11.75 | 41.5 |
| 32 | 5.8125 | 41.5 |
| 33 | 12 | 41.5 |
| 34 | 6.0 | 41.5 |
| 35 | 24.0625 | 41.5 |
| 36 | 6.0 | 41.5 |
| 37 | 12 | 41.5 |
| 38 | 5.8125 | 41.5 |
| 39 | 11.75 | 41.5 |

| Slot | Broad End Thickness (inches) | Narrow End Thickness [xxxx] (inches) | Length (inches) |
|---|---|---|---|
| 5 | 0.98 | 0.52 | 4.7513 |
| 6 | 0.98 | 0.52 | 4.7513 |
| 7 | 0.98 | 0.52 | 4.7513 |

| Slot | Distance to Bottom Edge (inches) | Thickness [x] (inches) | Short Slot Segment (inches) | Long Slot Segment (inches) |
|---|---|---|---|---|
| 11 | 13.875 | 0.1875 | 3 | 4.375 |
| 12 | 9.9 | 0.1875 | 3 | 4.375 |
| 13 | 13.875 | 0.1875 | 2.8941 | — |
| 14 | 9.9 | 0.1875 | 2.8941 | — |

In such implementations, the panels and slots of sheet C have the following dimensions outlined in these tables.

| Panel | Width (inches) | Height (inches) |
|---|---|---|
| 41 | 11.75 | 41.5 |
| 42 | 5.8125 | 41.5 |
| 43 | 12 | 41.5 |
| 44 | 6.0 | 41.5 |
| 45 | 24.0625 | 41.5 |
| 46 | 6.0 | 41.5 |
| 47 | 12 | 41.5 |
| 48 | 5.8125 | 41.5 |
| 49 | 11.75 | 41.5 |

| Slot | Broad End Thickness (inches) | Narrow End Thickness [xxxx] (inches) | Length (inches) |
|---|---|---|---|
| 8 | 0.98 | 0.52 | 4.7513 |
| 9 | 0.98 | 0.52 | 4.7513 |
| 10 | 0.98 | 0.52 | 4.7513 |

| Slot | Distance to Bottom Edge (inches) | Thickness [x] (inches) | Short Slot Segment (inches) | Long Slot Segment (inches) |
|---|---|---|---|---|
| 15 | 13.875 | 0.1875 | 3 | 4.375 |
| 16 | 9.9 | 0.1875 | 3 | 4.375 |
| 17 | 13.875 | 0.1875 | 2.8941 | — |
| 18 | 9.9 | 0.1875 | 2.8941 | — |

In such implementations, the panels and slots of sheet D have the following dimensions outlined in these tables.

| Panel | Width (inches) | Height (inches) |
|---|---|---|
| 51 | 30.5 | 5.75 |
| 52 | 30.125 | 3.8125 |
| 53 | 39.25 | 6 |
| 54 | 39.25 | 4 |
| 55 | 39.25 | 6 |
| 56 | 4.5625 | 3.4375 |
| 57 | 4.5625 | 3.4375 |

| Slot | Thickness [x] (inches) | Length (inches) | Distance to Edge (inches) |
|---|---|---|---|
| 113 | 0.1875 | 3 | 4 |
| 114 | 0.1875 | 3 | 4 |
| 115 | 0.1875 | 3 | 4 |
| 116 | 0.1875 | 3 | 4 |

A wide variety of other examples fall within the concepts that we are discussing here. Among other things, the slots should have dimensions and configurations such that when the pieces of the item of furniture are assembled, the slotted joints formed by the slots and the portions of cardboard with which they interact achieve stability and strength in the ways that we have described.

Figure 4:
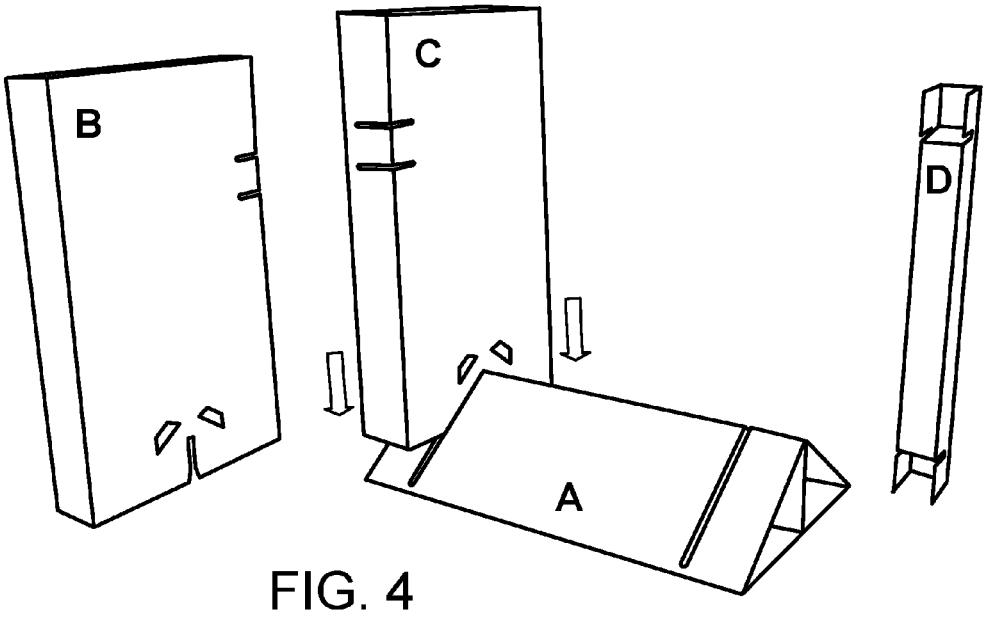
FIG. 4 is an isometric view of a partially assembled standing desk in which prism C is being inserted into prism A.

Desk Folding:

To assemble the furniture piece, sheets A, B, C, D are folded into separate elongated prism structures. (FIG. 1, FIG. 4)

Figure 6:
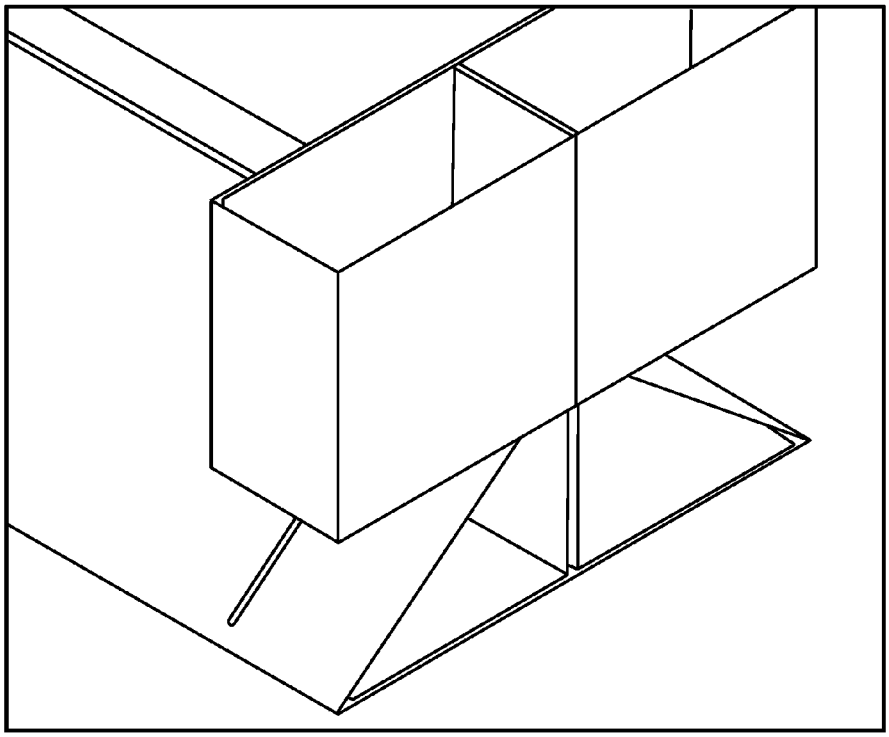
FIG. 6 is a shaded detail of an outer face of a locking joint that connects a standing desk vertical support to a work surface.

Sheet A is folded into two conjoined right triangle prisms by first mating the rear side of panel 20 with the front side of panel 23 and then mating the rear side of panel 26 with the front side of panel 23 such that rear sides of panels 21, 25 also mate with one another. When sheet A is folded, slots 1, 3 align and slots 2, 4 align to create compound slots here referred to as slots A1, A2 respectively. Sheet A in its folded state, which includes the two conjoined prisms, is referred to as prism A. (FIG. 1, FIG. 4, FIG. 6)

Sheet B is folded into two conjoined rectangular prisms by first mating the rear side of panel 31 with the front side of panel 35 and then mating the rear side of panel 39 with the front side of panel 35 such that the rear side of panels 32, 38 also mate with one another. Since quadruple slots 5, 7 are subdivided by scores 71, 78 respectively, when folded and positioned adjacently they add together to form a quadruple slot which aligns with quadruple slot 6. When sheet B is folded slots 5, 6, 7 align to create a compound slot here referred to as compound slot B1. Slots 11, 12 align with slots 13, 14 respectively to create compound slots here referred to as compound slots B2, B3 respectively. Sheet B in its folded state, which includes the two conjoined prisms, is here referred to as prism B. (FIG. 1, FIG. 4, FIG. 6)

Sheet C, like sheet B, is folded into two conjoined rectangular prisms by first mating the rear side of panel 41 with the front side of panel 45 and then mating the rear side of panel 49 with the front side of panel 45 such that the rear side of panels 42, 48 also mate with one another. Since quadruple slots 8, 10 are subdivided by scores 81, 88 respectively, when folded and positioned adjacently they add together to form quadruple slot which aligns with quadruple slot 9. When sheet C is folded slots 8, 9, 10 align to create a compound slot here referred to compound slot C1. Slots 15, 16 align with slots 17, 18 respectively to create compound slots here referred to as compound slots C2, C3 respectively. Sheet C in its folded state, which includes the two conjoined prisms, is here referred to as prism C. (FIG. 1, FIG. 4)

Sheet D is folded into a simple rectangular prism by mating the rear side of panel 51 with the front side of panel 55. Panels 56 are folded such that they lie perpendicular to planes created by panels 51, 52, 53, 54, 55 and cap the ends of the rectangular prism. Sheet D in its folded state is here referred to as prism D. (FIG. 1, FIG. 4)

Figure 7:
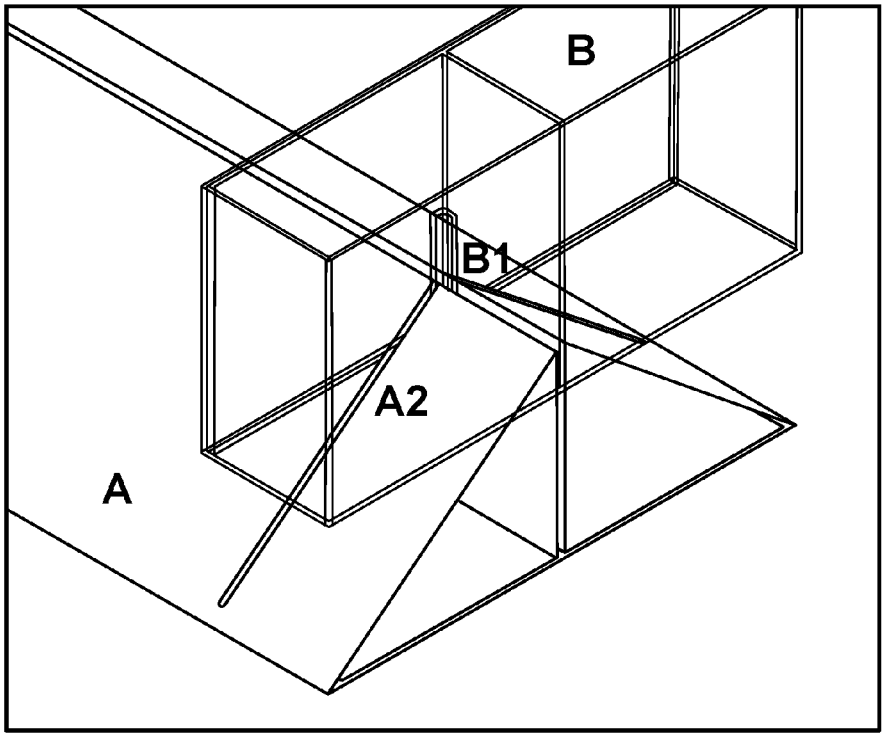
FIG. 7 is a wireframe detail of an outer face of a locking joint that connects a standing desk vertical support to a work surface.
Figure 8:
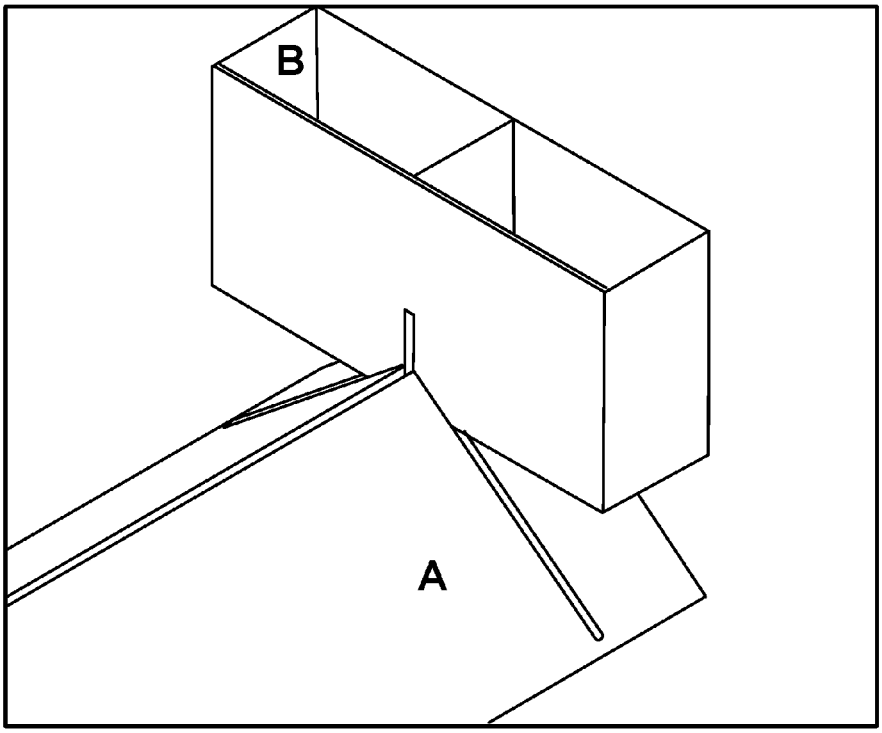
FIG. 8 is a shaded detail of an inner face of a locking joint that connects a standing desk vertical support to a work surface.
Figure 9:
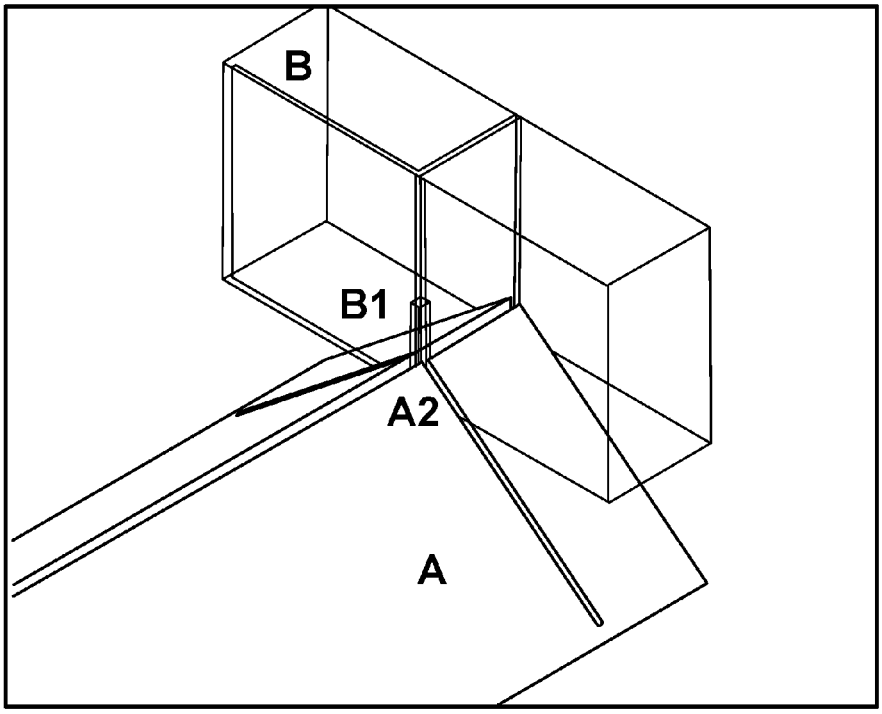
FIG. 9 is a wireframe detail of an inner face of a novel locking joint that connects a standing desk vertical support to a work surface.

Desk Assembly:

Assembly of the furniture piece is achieved by firstly interlocking prism A and prism B such that compound slot A2 mates with compound tapered slot B1. (FIG. 6, FIG. 7, FIG. 8, FIG. 9). FIGS. 6-9 display a truncated portion of prism B to illustrate its internal folding structure which creates a t-shaped slot-mate structure. This mate is achieved by inserting prism B's coincident panels 31, 35, 39 into compound slot A2 and simultaneously inserting prism B's coincident panels 32, 38 such that they wedge between prism A's right coincident panels 21, 25 of its two right triangular prisms. (FIG. 7, FIG. 9)

Assembly is continued by next interlocking prism A and prism C in a similar way, such that compound slot A1 mates with compound tapered slot C1. This mate is achieved by inserting prism C's coincident panels 41, 45, 49 into compound slot A1 and simultaneously inserting prism C's coincident panels 42, 48 such that they wedge between prism A's right coincident panels 21, 25 of its two right triangular prisms. (FIG. 1)

Figure 2:
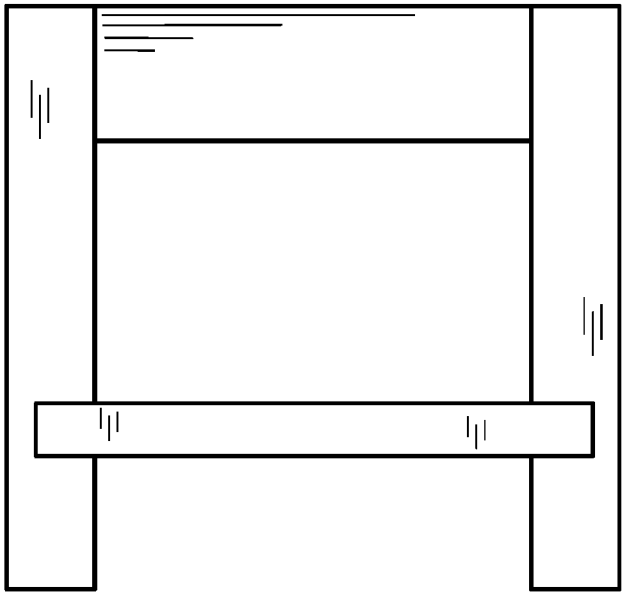
FIG. 2 is a front view of a fully assembled standing desk.
Figure 3:
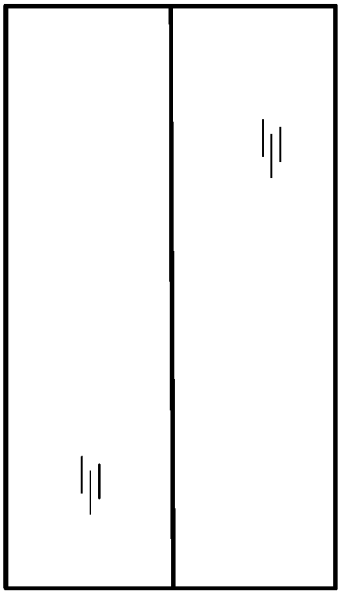
FIG. 3 is a side view of a fully assembled standing desk.
Figure 5:
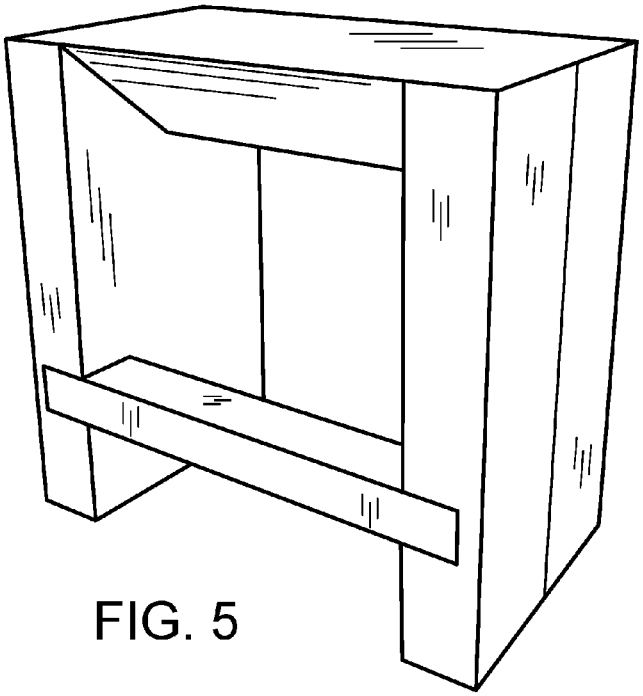
FIG. 5 is a fully assembled isometric view of a standing desk.

More simply, when viewed from above Prism A (the work surface) has two T-shaped female channels that receive the T-shaped male plugs created by the adjacent rectangular prisms in Prism B and C (the vertical support structures). (FIG. 4, FIG. 6, FIG. 8). This unique slot mate design stiffens as prisms B, C are inserted into prism A. Tapered compound slots B1, C1 clamp together the work surface's adjacent triangular prisms while the inner bisecting panels of the two vertical support structures wedge apart the work surface's triangular prisms. (FIG. 7, FIG. 9). By simultaneously separating and compressing the adjacent triangular prisms of the work surface, the joints achieve both strength and stiffness. This novel joint design provides stability while minimizing weight and complexity of the disclosed furniture piece. (FIG. 2, FIG. 3, FIG. 5)

A support brace may be added to the furniture piece to provide further lateral stability for the structure by interlocking prism D with prisms B, C. This mate is achieved by inserting slots 113 and 115 into compound slots B2 and B3 respectively and simultaneously inserting slots 114 and 116 into compound slots C2 and C3 respectively. The mate is configured such that panel 54 on prism D lies flush with panels 36 on prism B and 44 on prism C. The mate is also configured such that panels 56, 57 on prism D lie flush with panel 35 on prism B and panel 45 on prism C respectively. Support brace prism D wedges apart vertical support prisms B and C to increase stiffness and lateral stability of the disclosed furniture piece. This is achieved because the horizontal distance between slot pair 113,115 and slot pair 114,116 in prism D is slightly greater than the slot distances between compound slots A1 and A2 in prism A.

Other Embodiments of the Desk

A wide variety of other embodiments of desks and other pieces of furniture can make use of the principles that we describe here. For example, in some embodiments of a furniture piece, the heights of vertical support prisms B, C can be shortened or increased to cater to a wider range of user heights. In some implementations, the heights of the vertical support prisms B, C can be radically shortened and prism D and corresponding compound slots B2, B3 in prism B and compound slots C2, C3 in prism C can be eliminated such that the furniture piece can be placed upon a the surface of a sedentary desk to transform it into a standing desk. In some implementations, prisms B, C can be designed so that prism A rests on an incline to achieve an inclined standing work surface.

Other implementations are also within the scope of the following claims.

For example, although we sometimes refer to the cardboard as being single-wall, it is also possible to use other categories of cardboard.

The invention claimed is:

1. A cardboard furniture structure comprising at least two separate folded cardboard structural pieces, a first one of the two pieces configured to be supported from a floor, a second one of the two pieces comprising a non-vertical functional surface, the two separate folded cardboard structural pieces being interconnected by at least one slot joint configured to hold the two separate folded cardboard structural pieces together, the slot joint comprising at least two mating slots respectively on the two folded cardboard structural pieces, and when the slots have been mated to form the slot joint, at least a portion of one of the folded cardboard structural pieces lies between and tends to wedge apart at least two portions of the other folded cardboard structural piece at one of the slot joints.

2. The cardboard furniture structure of claim 1 comprising a third separate folded cardboard structural piece configured to be supported from the floor.

3. The cardboard furniture structure of claim 2 comprising a fourth separate folded cardboard structural piece, the fourth piece being configured to connect to the first and third pieces at slot joints.

4. The cardboard furniture structure of claim 1 in which the non-vertical functional surface comprises a desk surface.

5. The cardboard furniture structure of claim 1 comprising a desk.

6. The cardboard furniture structure of claim 5 comprising a standup desk.

7. The cardboard furniture structure of claim 5 comprising a desk that is configured to be placed on an existing desk to form a standup desk.

8. The cardboard furniture structure of claim 1 in which the second piece comprises two prisms.

9. The cardboard furniture structure of claim 8 in which at least one of the prisms comprises a triangular prism.

10. The cardboard furniture structure of claim 1 in which the first piece comprises two prisms.

11. The cardboard furniture structure of claim 10 in which at least one of the prisms comprises a rectangular prism.

12. The cardboard furniture structure of claim 1 in which at least one of the slots of one of the slot joints is tapered.

13. The cardboard furniture structure of claim 1 in which the portion of the one of the folded cardboard structural pieces and the portions of the other one of the folded cardboard structural pieces also are compressed by the mating of the slots.

14. A method of forming a cardboard furniture structure comprising folding at least two sheets of cardboard to form two folded cardboard structural pieces each including a mating slot, mating the mating slot on one of the structural pieces with the mating slot on the other piece to form a slot joint that connects the two pieces, the mating of the mating slots causing at least a portion of the one of the folded cardboard structural pieces to lie between and wedge apart at least two portions of the one of the folded cardboard structural pieces.

15. The method of claim 14 comprising folding a third sheet of cardboard to form a third cardboard structural piece and a slot of the third structural piece, and mating the slot of the third structural piece with one of the two structural pieces to form a slot joint that connects the pieces.

16. The method of claim 14 in which the mating of the mating slots also causes one of the folded cardboard structural pieces to compress portions of the other one of the folded cardboard structural pieces.

17. A cardboard standup desk comprising two folded cardboard upright support pieces, each of the two upright support pieces comprising two rectangular prisms and a slot formed on the folded cardboard upright support piece, a third folded single-wall cardboard work surface piece, the third piece comprising two triangular prisms and two slots each formed on the cardboard work surface piece, the two slots of the work surface piece being mated with the two respective slots of the two vertical support pieces, a fourth folded cardboard non-vertical support piece connecting the two vertical support pieces at a location below the work surface piece.

* * * * *